United States Patent [19]

Zimmerman

[11] 4,323,116

[45] Apr. 6, 1982

[54] FLOW CONTROL APPARATUS

[75] Inventor: Charles J. Zimmerman, Monroe, Mich.

[73] Assignee: Carrier Corporation, Syracuse, N.Y.

[21] Appl. No.: 104,512

[22] Filed: Dec. 17, 1979

[51] Int. Cl.[3] ..... F28F 27/02

[52] U.S. Cl. ..... 165/97; 165/176

[58] Field of Search ..... 165/97, 176

[56] References Cited

U.S. PATENT DOCUMENTS

| | | | |
|---|---|---|---|
| 127,768 | 6/1872 | Hewes | 137/625.33 |
| 1,637,736 | 8/1927 | Conrader | 251/203 |
| 3,211,217 | 10/1965 | McKee et al. | 165/95 |
| 3,319,710 | 5/1967 | Heeren et al. | 165/95 |
| 3,370,647 | 2/1968 | Hamm | 165/97 |
| 3,473,961 | 10/1969 | Heeren et al. | 165/95 X |
| 3,973,592 | 8/1976 | Cleaver et al. | 137/625.43 |

FOREIGN PATENT DOCUMENTS

| | | | |
|---|---|---|---|
| 756439 | 3/1971 | Belgium | 165/97 |
| 1012613 | 7/1957 | Fed. Rep. of Germany | 165/176 |
| 884364 | of 1943 | France | 165/97 |

*Primary Examiner*—Sheldon J. Richter

*Attorney, Agent, or Firm*—J. Raymond Curtin; John S. Sensny

[57] ABSTRACT

A flow control apparatus for use with a heat exchanger having a plurality of heat exchange tubes. The flow control apparatus comprises a housing; and the housing is divided into a first compartment for communication with a first set of heat exchanger tubes, a second compartment for communication with a second set of heat exchange tubes, an inlet compartment for connection to an external fluid source, and an outlet compartment for discharging fluid from the housing. First, second, third, and fourth ports are provided for transmitting fluid between, respectively, the first and outlet compartments, the first and inlet compartments, the second and inlet compartments, and the second and outlet compartments. The flow control apparatus further comprises a flow control gate having a normal flow position directing fluid through the second and fourth ports, and a reverse flow position directing fluid through the first and third ports.

5 Claims, 9 Drawing Figures

FLOW CONTROL APPARATUS

BACKGROUND OF THE INVENTION

This invention relates generally to fluid flow control apparatus, and more particularly to a diverter box for reversing the flow of fluid through a heat exchanger.

Flow control apparatus or devices are frequently employed to periodically reverse the flow of a fluid through a heat exchanger to dislodge and flush debris therefrom. For example, often water from natural sources such as rivers and lakes typically includes a significant amount of particulates or debris; and, when such water is conducted through the tubes of a heat exchanger, these particulates and debris tend to collect or accumulate in the tubes, restricting the water flow therethrough and thus impairing the efficiency of the heat exchanger. Reversing the water flow through the heat exchange tubes tends to dislodge debris therefrom, cleaning the tubes and enabling the tubes to operate with greater efficiency.

Prior art devices for reversing the flow of fluid through a heat exchanger are often cumbersome and involve numerous moving parts. In addition, debris in the water flowing through prior art flow control apparatus may collect and accumulate therein, impeding operation thereof. This may necessitate frequent cleaning of the apparatus, and this often involves expensive manual labor and requires temporarily taking the flow control apparatus out of operation. Moreover, prior art devices generally require positive action by a drive or power means both to change the device to a reverse flow position and to return the device to a normal flow position. This raises the possibility that, in case of a failure of the drive or power means, the flow control device may become locked in the reverse flow position, which typically results in the heat exchanger operating less efficiently than when the flow control device is in its normal flow position.

SUMMARY OF THE INVENTION

In view of the above, an object of the present invention is to improve devices for reversing the flow of a fluid through a heat exchanger.

Another object of this invention is to taper edges of a flow control gate of a flow control apparatus to facilitate moving the control gate into a fluid tight position.

A further object of the present invention is to automatically return a flow control device to a normal flow position in case of a failure of a drive or power means used to change the device between the normal position and a reverse flow position.

Still another object of this invention is to use the force of gravity to assist moving a flow control device from a reverse flow position to a normal flow position.

Another object of the present invention is to periodically and automatically clean interior parts of a flow control device to prevent the accumulation of deposits or debris therein.

These and other objectives are attained with a flow control apparatus for use with a heat exchanger having a plurality of heat exchange tubes. The flow control apparatus comprises a housing; and the housing is divided into a first compartment for communication with a first set of heat exchange tubes, a second compartment for communication with a second set of heat exchange tubes, an inlet compartment for connection to an external fluid source, and an outlet compartment for discharging fluid from the housing. First, second, third, and fourth ports are provided for transmitting fluid between, respectively, the first and outlet compartments, the first and inlet compartments, the second and inlet compartments, and the second and outlet compartments. The flow control apparatus also comprises flow control gate means having a normal flow position for directing fluid through the second and fourth ports, and a reverse flow position for directing fluid through the first and third ports, and means is provided for changing the flow control gate between the normal and reverse flow positions.

A BRIEF DESCRIPTION OF THE DRAWINGS

A DETAILED DESCRIPTION OF THE PREFERRED EMBODIMENT

Figure 2:
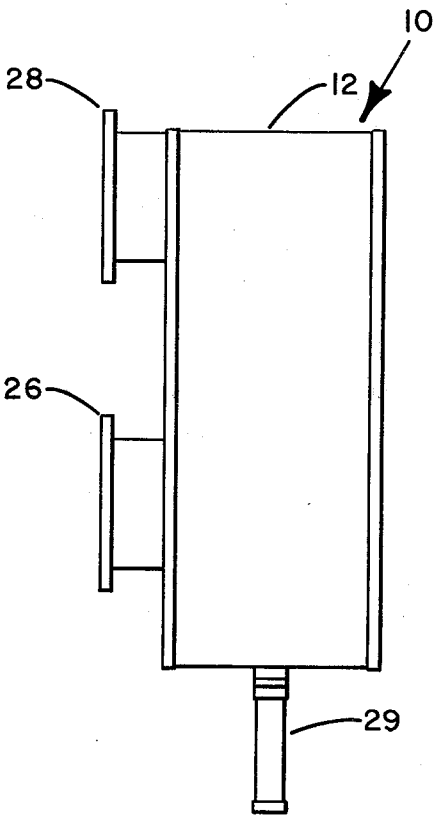
FIGS. 1 and 2 are front and side views respectively of a flow control apparatus constructed according to the present invention.

Particularly referring to FIGS. 1 through 4, there is disclosed water flow control apparatus or diverter box 10 constructed in accordance with the present invention. Apparatus 10 includes, generally, housing or frame 12, stationary wall members 14, 16, 18, and 20, movable wall member or flow control gate 22, wedges 24, inlet connection 26, outlet connection 28, and hydraulic cylinder 29. Stationary wall members 14, 16, 18, and 20 divide housing 12 into first or lower compartment 30, second or upper compartment 32, inlet compartment 34, and outlet compartment 36. It should be noted that arrangements for dividing housing 12 into the first, second, inlet, and outlet compartments other than as specifically illustrated in the drawings are known in the art and may be employed in the practice of the present invention. For example, instead of compartment 32 being positioned above compartment 30 as shown in the drawings, which changes well within the purview of those skilled in the art, these two compartments may be located side-by-side.

Referring back to FIGS. 1 through 4, inlet connection 26 leads into inlet compartment 34, and outlet connection 28 leads from outlet compartment 36. Observation ports 37 and 38 may be provided for inspecting the interior of inlet compartment 34 and outlet compartment 36 respectively. Wall member 14 defines openings 39, 40, 42, and 44; and these openings are aligned, respectively, with openings 46, 48, 50, and 52 which are defined by wall member 16. Openings 39 and 46, 40 and 48, 42 and 50, and 44 and 52 define, respectively, ports 56, 58, 60, and 62 for transmitting fluid between, respectively, outlet compartment 36 and lower compartment 30, inlet compartment 34 and the lower compartment, the inlet compartment and upper compartment 32, and the outlet compartment and the upper compartment.

Flow control gate 22 has a normal flow position closing ports 56 and 60 and allowing fluid flow through ports 58 and 62, and a reverse flow position allowing fluid flow through ports 56 and 60 and closing ports 58 and 62. Moreover, in accordance with one aspect of the present invention, flow control gate 22 is lowered to change the control gate from the reverse flow position to the normal flow position whereby the force of gravity urges the flow control gate to the normal flow position. More particularly, referring to the preferred embodiment illustrated in the drawings, wall members 14 and 16 are substantially vertical, planar, and parallel, defining space 64 therebetween. Control gate 22 is positioned in space 64 for vertical sliding movement between a normal flow position, shown in FIG. 3, and a reverse flow position, shown in FIG. 4.

Figure 3:
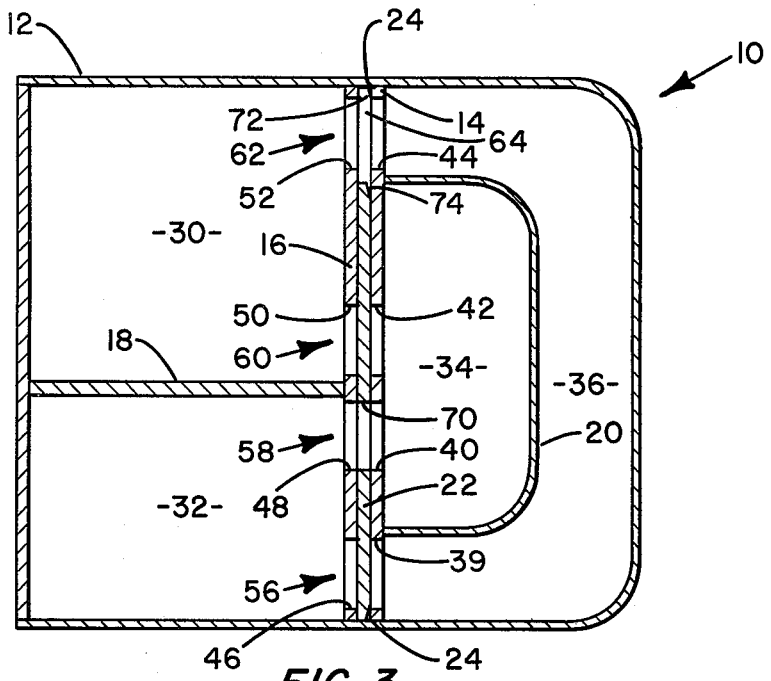
FIGS. 3 and 4 are front sectional views of the flow control apparatus shown in FIGS. 1 and 2, with FIG. 3 showing the apparatus in a normal flow position and FIG. 4 showing the apparatus in a reverse flow position.
Figure 4:
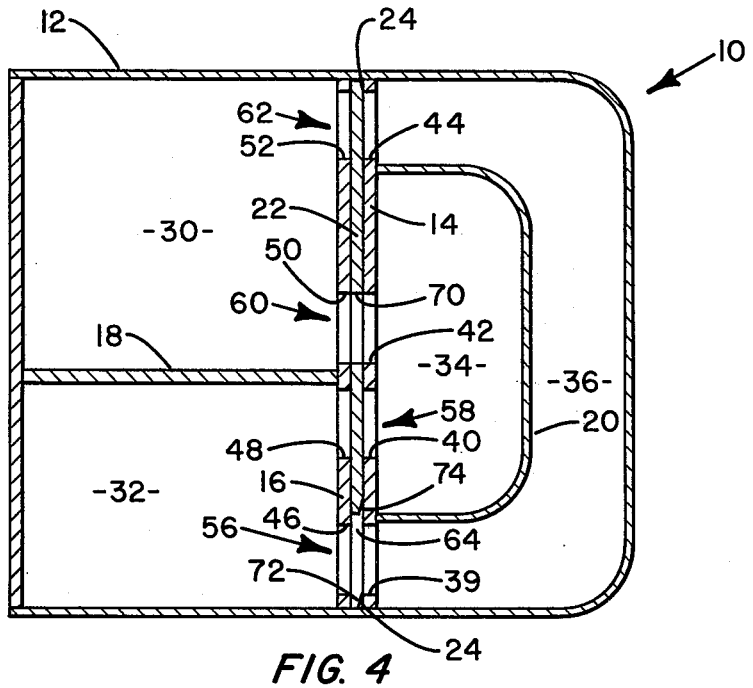

Flow control gate 22 defines opening 70 (best seen in FIG. 5), and when the control gate is in the normal flow position shown in FIG. 3, opening 70 is aligned with port 58 for allowing fluid flow therethrough. At the same time, control gate 22 extends over openings 39, 42, 46, and 50 in a close fitting relation with the wall members defining these openings for preventing fluid flow through ports 56 and 60. However, the top of control gate 22 is below openings 44 and 52, allowing fluid flow through port 62. When control gate 22 is in the reverse flow position shown in FIG. 4, opening 70 of the control gate is aligned with port 60 for allowing fluid flow therethrough, and the bottom of the control gate is above openings 39 and 46, allowing fluid flow through port 56. However, control gate 22 extends over openings 40, 44, 48, and 52 in a close, tight fitting relation with the wall members defining these openings for preventing fluid flow through ports 58 and 62.

Figure 1:
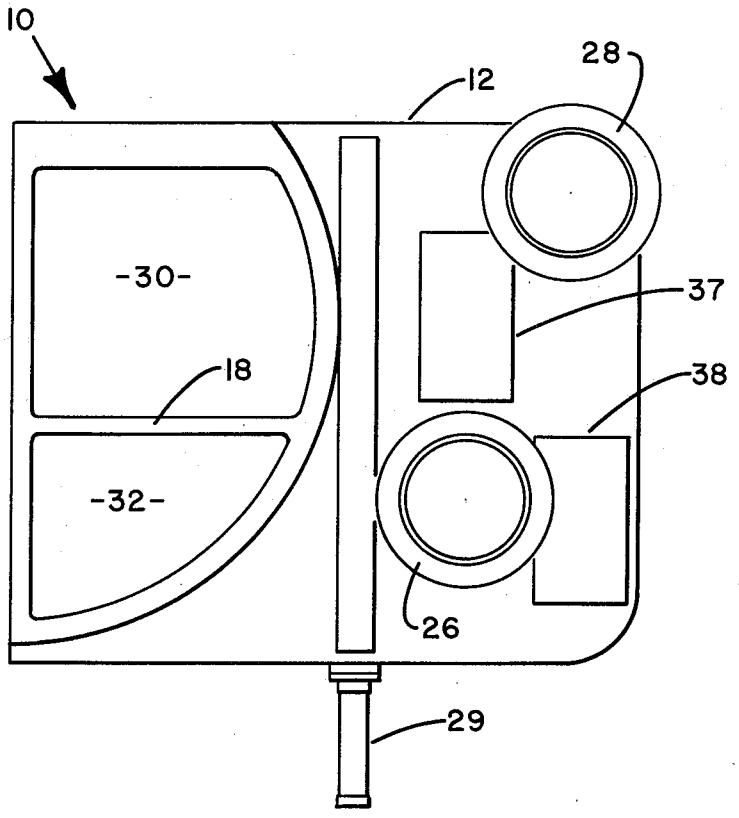

As will be apparent to those skilled in the art, any suitable drive or power means, for example an electric motor, may be employed to change flow control gate 22 between the reverse and normal flow positions. Preferably, though, hydraulic cylinder 29 is used to move control gate 22 within space 64. Referring to FIGS. 1 and 2, hydraulic cylinder 29 is secured to housing 12 directly below control gate 22, and an extensible piston (not shown) of the cylinder is connected to the control gate via projection 68 (best seen in FIGS. 5 and 6) thereof. In this manner, control gate 22 is moved upwards and downwards within space 64 by, respectively, extension and retraction of the piston of hydraulic cylinder 29. Operation of cylinder 29 may be controlled by limit switches (not shown) which sense the position of control gate 22.

It should be noted that employing the force of gravity to urge flow control gate to the normal flow position has several advantages. First, the force of gravity assists moving control gate 22 into the normal flow position, reducing the amount of work which must be done by the power means employed to so move the control gate. Second, flow control apparatus 10 is designed for use with a heat exchanger to reverse the fluid flow therethrough, and typically it is preferred to operate the heat exchanger with apparatus 10 in the normal flow position. For example, the normal flow path through the heat exchanger may provide more efficient heat transfer between the fluids passing therethrough. Hence, if control gate 22 is in the reverse position and there is a failure in the power means used to move the control gate into the reverse flow position, then the force of gravity will automatically return the control gate to the normal flow position. Thus, flow control apparatus 10 will reliably return to the preferred, normal flow position even if there is a failure in the power means employed with the apparatus.

Figure 8:
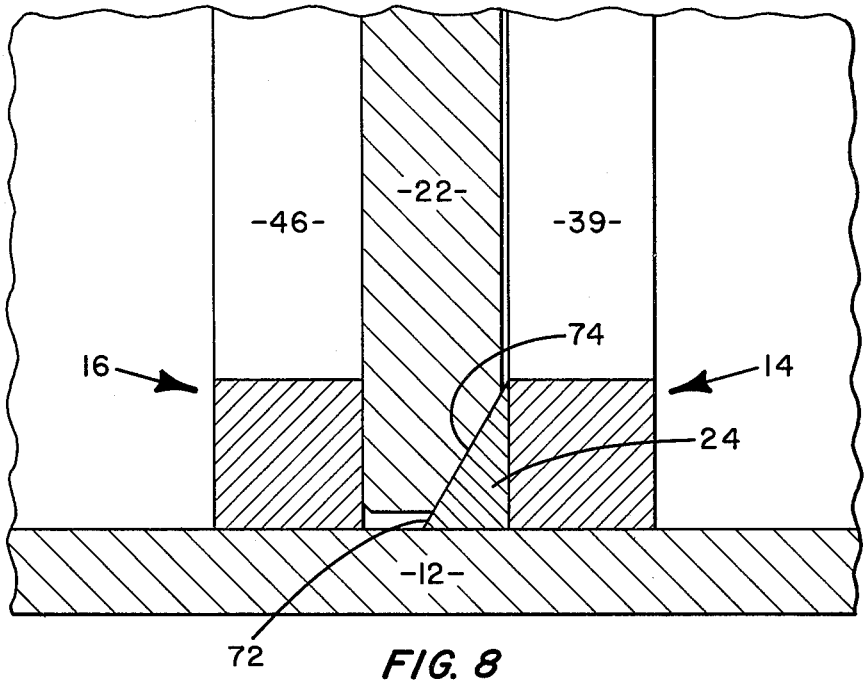
FIG. 8 is an enlarged view of portions of FIG. 3, showing the wedges of the flow control apparatus and the tapered ends of the control gate thereof in greater detail.

In accordance with another aspect of this invention, as may be best understood from FIG. 8, as control gate 22 moves into the normal and reverse flow positions, wedges 24 facilitate forming a fluid tight abutting fit between the control gate and wall member 16. More particularly, as control gate 22 slides within space 64 toward the normal or reverse flow position, ends of the control gate slidingly contact wedges 24. Further movement of control gate 22 forces the gate along angled surface 72 of wedges 24, forcing the control gate against wall member 16. Wedges 24 also gradually decelerate control gate 22 and limit vertical travel thereof, preventing the control gate from directly striking and thus possibly damaging housing 12. Preferably, the ends of control gate 22 which contact wedges 24 define tapered surfaces 74 to assist sliding the control gate along surfaces 72 of the wedges. Tapered surfaces 74 also prevent control gate 22 from binding within space 64 against wall member 14, and opposite edges of the control gate may be chamferred to prevent the control gate from binding against wall member 16.

Figure 5:
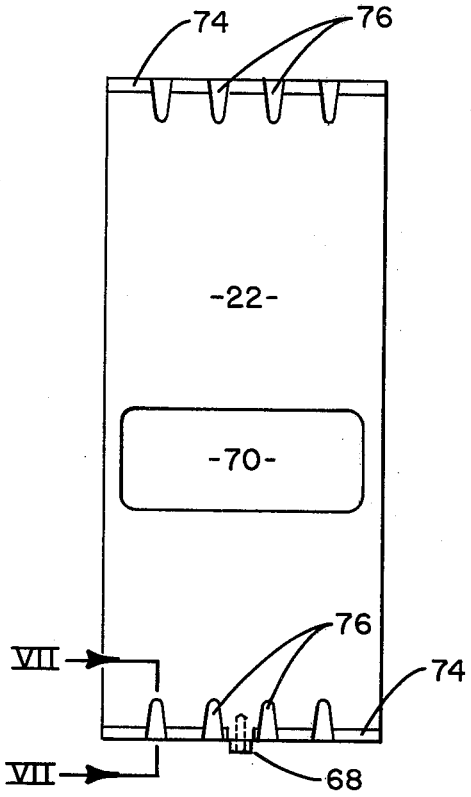
FIGS. 5 and 6 are front and side views respectively of the flow control gate used in the flow control apparatus shown in FIGS. 1 through 4.
Figure 6:
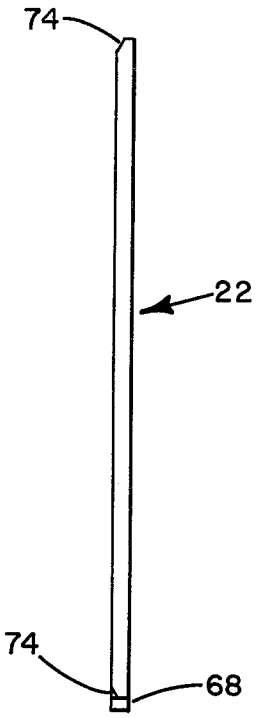
Figure 7:
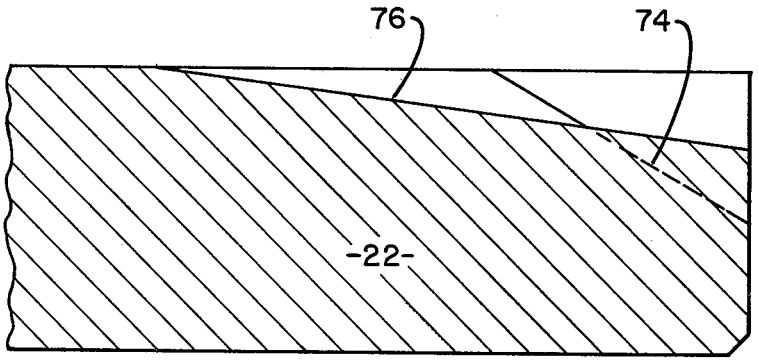
FIG. 7 is an enlarged view taken along line VII—VII of FIG. 5.

In addition to the foregoing, referring to FIGS. 5 and 7, the ends of control gate 22 define clean out slots or depressions 76 to prevent the accumulation of debris within space 64. For example, referring now to FIGS. 5, 7, and 8, as control gate 22 moves downward into the normal flow position, any sludge or debris located within space 64 and below the control gate becomes squeezed into the space between the bottom of the control gate, housing 21, and wall members 14 and 16. Clean out slots 76 provide an opening in communication with this space, and further downward movement of control gate 22 forces the sludge and debris upward along the clean out slots and into opening 39. This debris is then flushed away by fluid passing through opening 39 the next time control gate 22 is moved to the reverse flow position. Similarly, as control gate 22 moves upward into the reverse flow position, debris located within space 64 and above the control gate is forced downward and through clean out slots 76. The debris is forced into opening 44 and is flushed therefrom by fluid flowing therethrough when control gate 22 is returned to the normal flow position. Thus, flow control apparatus 10 provides regular and automatic self cleaning, substantially decreasing the time during which apparatus 10 is removed from operation for cleaning and significantly reducing the amount of costly manual labor needed to clean the flow control apparatus.

As mentioned above, flow control apparatus 10 is intended for use with a heat exchanger for reversing the fluid flow therethrough. For example, apparatus 10 may be employed with heat exchanger 78 shown in FIG. 9. Heat exchanger 78 is of the tube and shell type including tubular outer shell 80, a plurality of heat exchange tubes 82, tube sheets 84 and 86, inlet 88, and outlet 90. Flow control apparatus 10 is connected to a first longitudinal end of heat exchanger 78, and water box 92 is connected to the second longitudinal end of the heat exchanger. Heat exchange tubes 82 are disposed within shell 80, and opposite ends of tubes 82 are connected to tube sheets 84 and 86 respectively. Also, heat exchange tubes 82 are arranged in two sets, upper set 94 and lower set 96. Upper set 94 is in fluid communication with upper compartment 32 of flow control apparatus 10, and lower set 96 is in fluid communication with lower compartment 30 of flow control apparatus 10.

Figure 9:
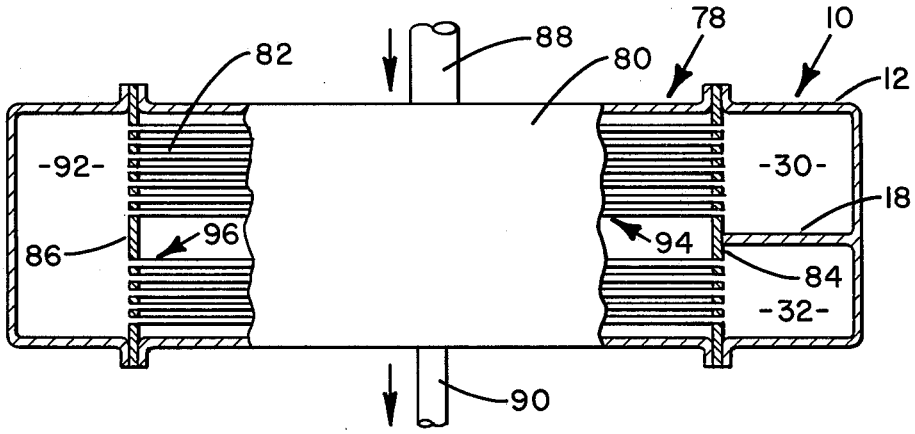
FIG. 9 is a longitudinal, sectional view of a heat exchanger employing the flow control apparatus shown in FIGS. 1 through 4.

In operation, a fluid to be cooled enters shell 80 via inlet 86, flows over tubes 82 in heat transfer relation therewith, and is discharged from shell 80 via outlet 90. At the same time, a cooling fluid is transmitted to inlet compartment 34 of flow control apparatus 10 from an external source thereof, for example a river or lake. Referring to FIGS. 3 and 9, when apparatus 10 is in the normal flow position, the cooling fluid passes from inlet compartment 34, through port 58, into lower compartment 30, and therefrom into and through lower set 96 of tubes 82. Water box 92 receives the fluid from lower set 96 and directs the fluid into upper set 94 which discharges the fluid into upper compartment 32. Therefrom the fluid passes through port 62, through outlet compartment 36, and through outlet connection 28.

To reverse the flow of fluid through tubes 82, the piston of hydraulic cylinder 29 is extended, sliding control gate 22 into the reverse flow position. Now, referring to FIGS. 4 and 9, the cooling fluid entering inlet compartment 34 via inlet connection 26 passes through port 60 and into upper compartment 32. From upper compartment 32, the fluid passes through upper set 94 of tubes 82, into and through water box 92, and thence through lower set 96 which empties the fluid into lower compartment 30. From lower compartment 30, the fluid passes through port 56, through outlet compartment 36, and then through outlet connection 28. This fluid flow reversal through tubes 82 tends to dislodge any accumulated debris therefrom, increasing the efficiency thereof. In addition, as is well known in the art, wire cages (not shown) may be located at each end of heat exchange tubes 82 and tube brushes (also not shown) may be positioned in the wire cages. With this arrangement, reversing the fluid flow through tubes 82 also pushes the tube brushes therethrough, further cleaning the interior thereof.

As may be appreciated from a review of the above discussion, flow control apparatus 10 is a compact and reliable mechanism for reversing the flow of fluid through heat exchanger 78. Moreover, apparatus 10 requires minimal skill in its assembly, repair, and maintenance, and the flow control apparatus includes several unique features which significantly improve operation thereof. For example, apparatus 10 employs the force of gravity to assist returning control gate 22 to its normal flow position and to insure that the gate does not become accidentally locked in the reverse flow position in case of a failure in hydraulic cylinder 29. Second, wedges 24 facilitate forming a fluid tight seal between control gate 22 and wall member 16, minimizing any undesirable fluid leakage therethrough. Furthermore, clean out slots 76 regularly and automatically clean deposits from space 64 between wall members 14 and 16, substantially reducing the cost and time needed to manually clean apparatus 10.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

I claim:

1. A flow control apparatus for use with a heat exchanger having a plurality of heat exchange tubes, the flow control apparatus comprising:

a housing;

means dividing the housing into a first compartment for communication with a first set of heat exchange tubes, a second compartment for communication with a second set of heat exchange tubes, an inlet compartment for connection to an external fluid source, and an outlet compartment for discharging fluid from the housing;

the dividing means defining a first port for transmitting fluid between the first and outlet compartments, a second port for transmitting fluid between the first and inlet compartments, a third port for transmitting fluid between the second and inlet compartments, and a fourth port for transmitting fluid between the second and outlet compartments;

flow control gate means having a normal flow position closing the first and third ports and allowing fluid flow through the second and fourth ports, and a reverse flow position closing the second and fourth ports and allowing fluid flow through the first and third ports;

the dividing means inclusing a first wall member, and the flow control gate means including a second wall member generally parallel to the first wall member and slidably disposed adjacent thereto, with the second wall member slidably moved relative to the first wall member to change the flow control gate means between the normal and reverse flow positions;

wedges for moving the second wall member into fluid tight, abutting contact with the first wall member as the second wall member slides relative thereto; and means for sliding the second wall member relative to the first wall member.

2. The flow control apparatus as defined by claim 1 wherein ends of the second wall member are tapered to facilitate moving the second wall member into abutting contact with the first wall member.

3. The flow control apparatus as defined by claims 1 or 2 wherein:

the dividing means further includes a third wall member spaced from and substantially parallel to the first wall member;

the second wall member is slidably disposed between the first and third wall members; and ends of the second wall member define clean out depressions to prevent debris from accumulating in the space between the first and third wall members.

4. The flow control apparatus as defined by claim 3 wherein:

the first wall member defines first, second, third, and fourth openings;

the third wall member defines fifth, sixth, seventh, and eighth openings;

the first and fifth openings define the first port, the second and sixth openings define the second port, the third and seventh openings define the third port, and the fourth and eighth openings define the fourth port;

the second wall member defines a ninth opening;

when the flow control gate is in the normal flow position, the ninth opening is aligned with the second port, allowing fluid flow therethrough; and when the flow control gate is in the reverse flow position, the ninth opening is aligned with the third port, allowing fluid flow therethrough.

5. The flow control apparatus as defined by claims 1 or 2 wherein:

the first wall member is substantially vertical;

the second wall member is slidably disposed adjacent to the first wall member; and the second wall member is lowered to change the flow control gate means from the reverse flow position to the normal flow position whereby the force of gravity urges the flow control gate means to the normal flow position.

* * * * *